US005123999A

United States Patent [19]

Honnorat et al.

[11] Patent Number: 5,123,999

[45] Date of Patent: Jun. 23, 1992

[54] FORGERY-PROOF SECURITY PAPER AND AQUEOUS OR ORGANIC COMPOSITION ESPECIALLY USEFUL FOR RENDERING PAPER FORGERY-PROOF

[75] Inventors: André Honnorat, Annecy; Claude Riou, Chemin des Trappes, both of France

[73] Assignee: Aussedat-Rey, France

[21] Appl. No.: 562,733

[22] Filed: Aug. 6, 1990

[30] Foreign Application Priority Data

Aug. 7, 1989 [FR] France ..... 89 10794

[51] Int. Cl.[5] ..... D21H 17/00

[52] U.S. Cl. ..... 162/140; 162/162; 162/158; 162/181.2; 162/165

[58] Field of Search ..... 162/140, 162, 181.2, 162/165, 158; 428/916; 427/7; 283/72

[56] References Cited

U.S. PATENT DOCUMENTS

| | | | |
|---|---|---|---|
| 227,559 | 5/1880 | McMahon et al. | 162/140 |
| 305,292 | 9/1884 | Clapp | 427/7 |
| 1,864,116 | 6/1932 | Bausch et al. | 162/140 |

FOREIGN PATENT DOCUMENTS

| | | | |
|---|---|---|---|
| 2432576 | 2/1980 | France | 162/140 |
| 609743 | 10/1948 | United Kingdom | 427/7 |

OTHER PUBLICATIONS

Whistler, Roy L. Industrial Guns: Polysaccharides and Their Derivatives, New York, Academic Press, 1959, pp. 265–266.

*Primary Examiner*—W. Gary Jones
*Assistant Examiner*—Brenda Lamb
*Attorney, Agent, or Firm*—Ostrolenk, Faber, Gerb & Soffen

[57] ABSTRACT

A forgery proof safety paper comprises, on its surface and/or in the body of a paper substrate, at least one compound of the formula

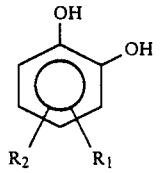

wherein $R_1$ is H or OH, and $R_2$ is H, COOH, CHO, COR, COOR or alkyl, R being a substituted or unsubstituted, linear, cyclic or aromatic hydrocarbon chain.

1 Claim, No Drawings

FORGERY-PROOF SECURITY PAPER AND AQUEOUS OR ORGANIC COMPOSITION EXPECIALLY USEFUL FOR RENDERING PAPER FORGERY-PROOF

The invention relates to the field of paper-making. It has as its object a novel forgery-proof security paper comprising an aromatic product and an aqueous or organic composition, particularly useful for rendering paper, of the type which is a substate for printing, forgery-proof with respect to reducing agents or any combination acting to intervene as reducing agents.

So-called safety papers which can be used, in particular, for making handwritten documents for payment or official documents, such as cheques, travellers' cheques etc, must be protected against any attempt at falsifying the franking or stamps borne on the papers, by means of any chemical reagent or modern process such as an ink eraser pencil. Such eraser pencils make it possible to eliminate cleanly the coloured inks employed at present for handwriting or printing by inking pads.

However, the majority of safety papers now available on the market react insufficiently to the attempts at falsification with ink eraser pencils, and present the drawback of considerably increasing the costs of the safety papers.

French Patent FR-A-2365656 discloses a safety paper comprising a chemical sensitising composition based on an acid-based indicator that is highly sensitive to pH variations. The indicator is selected in particular from the group of phthaleins or sulfophthaleins. When the pH rises (owing to the action of the eraser pencil), the paper develops a colouration. However, all the products described must be handled with care in paper-making, principally in view of their conditions of stabilisation, pH, use as well as reversibility or stability.

French Patent Fr-A-2399505 and its Certificate of Addition FR-E-2402739 describe a safety paper comprising a chemical sensitising composition based on a salt of oxypyrenetricarboxylic acid, called Pyranine. The action of an eraser pencil on such papers develops a fluorescent yellow colouration.

The presence of fluorescence in the paper is detrimental in many safety papers, and particularly in those comprising pigments and fluorescent fibres that are needed for authentication.

French Patent FR-A-2406027, Fr-A-2427426 and its Certificate of Addition FR-E-2432576 describe a safety paper comprising dinitrophenols which, under the action of an eraser pencil, are coloured non-fluorescent yellow.

French Patent FR-A-2410702 describes a safety paper comprising a chemical sensitising composition comprising Pyranine in association with an optical blue colourant and various other compounds. The action of an eraser felt on such paper leads to a fluorescent yellow colouration.

The object of the invention is to provide a compound which, associated with a paper, renders it forgery-proof with respect to reducing agents or any combination intervening as reducing agents, even eraser pencils, sodium sulphite or bisulphite, as well as bases, by developing a colouration clearly detectable to the naked eye, either instantaneously or sufficiently rapidly to hinder forgers, the paper being non-fluorescent.

The object of the invention is attained by the use of a substrate paper such as a forgery-proof safety paper, comprising, on its surface and/or in the body thereof, at least one compound of the formula:

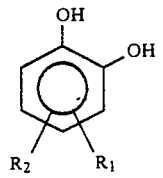

(1)

wherein $R_1$ is H or OH and $R_2$ is H, COOH, COOR, CHO, COR or alkyl, R being a substituted or unsubstituted, linear, cyclic or aromatic hydrocarbon chain. For example, R may comprise up to 20, e.g. up to 8, C atoms, optionally including heteroatoms. More than one ring of formula (1) may be bound to a polyvalent group R.

The paper comprises visible indicia, such as letters and/or numbers e.g. in an array, and/or pictures, in addition to the marker of formula (1).

The paper may have a fibrous composition such as purely cellulosic or partly synthetic, to which may be added conventional paper-making additives, i.e. inorganic fillers, various proofing agents, binders, resins, shading dyes, neutral, acid or basic sizing products, aluminum sulfate for acid-sizing or pH adjustment, etc.

Among the products which may be added to paper, activators and synthesising agents may be named. In general, it is appropriate to distinguish the salts of iron II or III which are to be ruled out as products which can be added, owing to their too great reactivity with the products of the invention and the other metals which can act as catalysts for the given forgery-proofing reactions.

The invention therefore also relates to a composition for rendering paper forgery-proof, comprising at least one compound of formula (1) and at least one compatible coating binder and/or an activator.

This activator is preferably chosen, on account of its complementary reactivity with respect to the other agents which are of potential use by forgers, among the family of manganese salts that do not colour paper (preferably $MnSO_4$) or, for reasons of cost, among such compounds as the salts of magnesium, nickel or zinc.

Other metal salts or oxides are envisaged and can be used to test for a greater proof against forgery with respect to given a reagent (sulphite, besulphite or eraser felt).

Numerous compounds of formula (1) may be suitable for the purposes of the present invention, provided that they have at least two OH groups in the ortho position. Among them, 2,3,4-trihydroxyacetophenone, propyl gallate, gallic acid, 1,2,4-benzenetriol and 3,4-dihydroxybenzaldehyde are preferred:

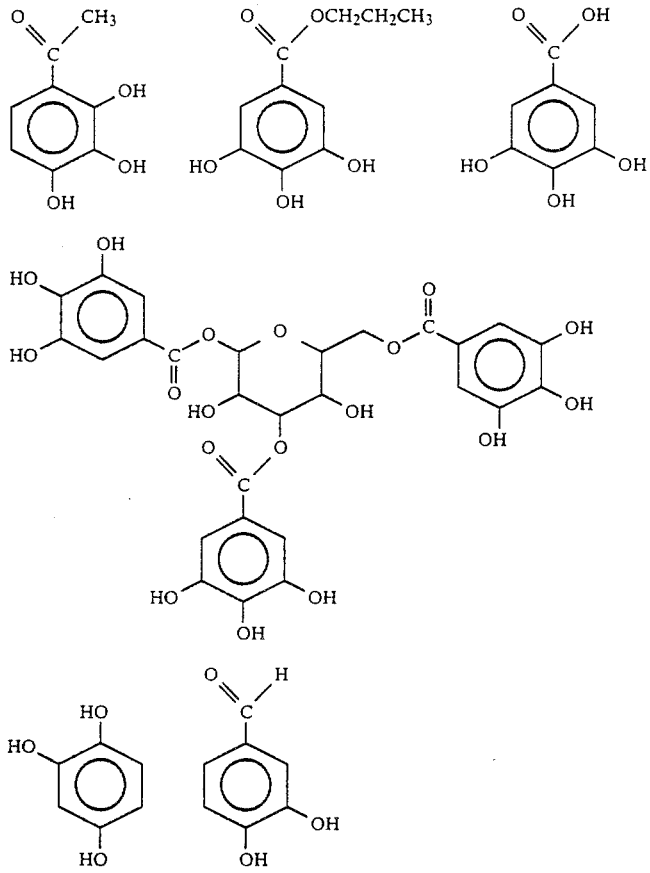

Furthermore, the paper preferably comprises, whatever the mode of addition, at least 0.01 g/m$^2$ of the compound of formula (1) and, advantageously, between 0.04 and 2 g/m$^2$.

The paper may also comprise sensitising reagents, similar to those already in present use in security papers, for example products providing a change in the appearance of the paper on contract thereof with acids, oxidising agents or oxidising/reducing combinations. These products are introduced in known manner, either directly onto the surface, for example by deposition or coating on the surface of paper, or in the body by means of an aqueous solution, in which case it is necessary to ensure their retention on the fibres by direct bonding or by means of bonding agents, or in the precipitated, micro-dispersed or pigmentary state.

There is no problem of compatibility between the sensitising agents and the compounds of formula (1), provided that the sensitising agents are neither basic, nor reducing agents, nor salts of iron II or III. In fact, the principal property, that is the object of the patent, arises from the formula of the products (1) developing a colouration in the presence of bases or reducing agents (principal components of ink eraser felt), an association of the products derived from formula (1) with the basic or reducing product leading to a coloured paper that is inert with respect to attempts at forgery using a base, a reducing agent or an eraser felt.

The papers may also contain in their body, in the dispersed pigmentary state, one or more water-insoluble but organo-soluble dyes, so as to preserve the writing or comments borne on these papers with respect to attempts at forgery using organic solvents. Moreover, these papers can be water-marked or contain various artefacts adapted to ensure recognition, such as coloured and/or flourescent fibres, pellets or particles.

The papers are rendered forgery-proof by a process which comprises associating the paper with at least one compound of formula (1).

A first modus operandi, for rendering a paper forgery-proof, comprises incorporating the compound of formula (1) during the paper manufacturing process.

A second modus operandi comprises depositing, on one or both surfaces of a sheet of paper, an aqueous composition comprising a compound of formula (1), as defined above, and a coating binder.

Coating binders include, by way of indication, synthetic or natural polymers having compatible hydroxyl terminal groups, such as starch and cellulosic derivatives.

The coating composition preferably comprises, in grams per liter of water:

| | |
|---|---|
| 1 or more compounds of formula (1) | 1 to 50 g |
| coating binder (according to the binder used) | 10 to 150 g |
| activator (such as $MnSO_4$, $MgSO_4$ etc) | 0 to 100 g |
| other adjuvants | 0 to 100 g |

These adjuvants can be additives conventionally used in paper-making, i.e., for example, antioxidants, whitening agents, binder-insolubilising products, etc.

A third modus operandi comprises depositing, on one or both surfaces of a sheet of paper, a composition comprising a compound of formula (1), an organic solvent and a compatible coating binder.

Solvents include esters, ketones, alcohols, oils and aromatic compounds, provided that the compounds are soluble therein.

This third modus operandi, however, gives a paper which does not react to the action of the precise solvent which was used during this process.

It should be explained that the term "composition" indicates the solutions, i.e. the compositions in which the components are dissolved, and also partial or non-solublised dispersions.

These compositions may be deposited by means of a coating technique used in paper-making (size-press, system using rolls, blades, etc).

This invention also relates to the compositions, coloured or not, as such.

EXAMPLE 1

On a paper substrate containing in the body thereof one or more dispersed organo-soluble dyes, these products being intended to give the paper the sensitivity to the solvents that may be used to falsify the paper, there is deposited on the surface, by a conventional paper-making technique (size-press, roller system), an aqueous coating solution comprising 20 g/l 2,3,4-trihydroxyacetophenone and 2 g/l carboxymethylcellulose of high viscosity.

The colouration obtained using ink eraser pencils, bases, sodium sulphite and sodium bisulphite is yellow.

The paper thus treated reacts, in addition, with solvents which colour the paper differently, depending on their nature and on the organo-soluble dyes introduced.

EXAMPLE 2

On a substrate paper containing in the body thereof organo-soluble dyes and a product adapted to render the paper sensitive to acids (the BASF cheque dye AS), there is deposited on the surface a coating solution containing 50 g/l propyl gallate and 100 g/l starch.

Reactions to attempts at falsification cause colourations that are pink-red with acids, orange-yellow with sulphite and bisulphite (the colouration develops with time), brown with bases, variable with solvents, depending on their function and the organo-soluble dyes introduced.

EXAMPLE 3

On a substrate paper of the type in Example 1, there is deposited an aqueous composition containing 40 g/l gallic acid, 10 g/l $MnSO_4$, 2 g/l high viscosity carboxymethylcellulose. The non-fluorescent paper thus obtained reacts: immediately pink, then turning orange and yellow with time, with eraser felts and sodium sulphite, yellow that develops with time with sodium bisulphite, brown with bases and Javel, variously depending on the applied solvent and the organo-soluble dyes introduced.

EXAMPLE 4

On a substrate paper of the type in Example 1, there is coated an aqueous composition comprising 40 g/l tannic acid, 10 g/l $MnSO_4$, 100 g/l starch.

The non-fluorescent and white paper thus obtained reacts: yellow-orange with time with sodium sulphite, brown with Javel and bases, variously depending on the solvent applied and the organo-soluble dyes introduced.

EXAMPLE 5

On a paper substrate containing no organo-soluble dyes, there is coated a composition comprising 1000 g ethyl acetate, 40 g 2,3,4-trihydroxyacetophenone, 40 g Ixan SGA ® (polyvinylidine chloride available from Solvay).

The non-fluorescent paper thus obtained reacts yellow with eraser pencils, bases, and sodium sulphite and bisulphite.

The invention is not limited to the given examples and represents various modifications that can be adduced without going beyond its scope.

What is claimed is:

1. A method for verifying the composition of paper, the paper comprising at least 0.01 g/m$^2$ of at least one compound of the formula

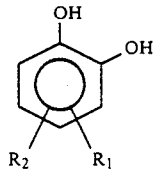

wherein $R_1$ is H or OH, and $R_2$ is H, COOH, CHO, COR, COOR or alkyl, R being a substituted or unsubstituted, linear, cyclic or aromatic hydrocarbon chain, and at least one activator selected from the group consisting of $MnSO_4$, $MgSO_4$, $NiSO_4$, and $ZnSO_4$, the paper being prepared by applying an aqueous composition to the paper, the aqueous composition including the activator in an amount greater than 0 and up to 100 g/l; the method comprising the step of applying a reducing agent to the paper, the reducing agent reacting with the compound in the paper to give a visible color change of the paper.

* * * * *